US007302944B2

(12) United States Patent
Judson

(10) Patent No.: US 7,302,944 B2
(45) Date of Patent: Dec. 4, 2007

(54) BARREL AND BALL SIZER FOR PAINT-BALL GUN

(75) Inventor: Robert Judson, Dallas, TX (US)

(73) Assignee: SJS Paintball, LP, Ricardson, TX (US)

( * ) Notice: Subject to any disclaimer, the term of this patent is extended or adjusted under 35 U.S.C. 154(b) by 99 days.

(21) Appl. No.: 10/840,147

(22) Filed: May 6, 2004

(65) Prior Publication Data

US 2005/0247295 A1 Nov. 10, 2005

(51) Int. Cl.
*F41B 11/00* (2006.01)

(52) U.S. Cl. ..... 124/83; 124/73

(58) Field of Classification Search ..... 124/73, 124/74, 83; 138/39, 109, 177, 178, 44; 141/331
See application file for complete search history.

(56) References Cited

U.S. PATENT DOCUMENTS

| | | | | | |
|---|---|---|---|---|---|
| 330,873 | A | * | 11/1885 | Cobb | 285/55 |
| 513,318 | A | * | 1/1894 | Grimm | 242/118.61 |
| 731,194 | A | * | 6/1903 | Lovekin | 110/323 |
| 1,238,672 | A | * | 8/1917 | Hopwood | 239/72 |
| 1,298,532 | A | * | 3/1919 | Mapelsden | 73/861.61 |
| 2,791,148 | A | * | 5/1957 | Maisch | 86/31 |
| 5,161,516 | A | | 11/1992 | Ekstrom | |
| 5,228,427 | A | * | 7/1993 | Gardner, Jr. | 124/71 |
| 5,333,594 | A | | 8/1994 | Robinson | |
| 5,462,042 | A | | 10/1995 | Greenwell | |
| 5,494,024 | A | | 2/1996 | Scott | |
| 5,505,188 | A | | 4/1996 | Williams | |
| 5,515,838 | A | | 5/1996 | Anderson | |
| 5,572,982 | A | | 11/1996 | Williams | |
| 5,599,187 | A | | 2/1997 | Mesiano | |
| 5,630,406 | A | | 5/1997 | Dumont | |
| 5,640,945 | A | | 6/1997 | Slonaker et al. | |
| 5,669,369 | A | | 9/1997 | Scott | |
| 5,823,173 | A | | 10/1998 | Slonaker et al. | |
| 5,850,826 | A | | 12/1998 | Guthrie | |
| 5,988,153 | A | | 11/1999 | Yoshimura | |
| 6,003,504 | A | | 12/1999 | Rice et al. | |
| 6,138,656 | A | | 10/2000 | Rice et al. | |
| 6,142,136 | A | | 11/2000 | Velasco | |
| 6,213,112 | B1 | | 4/2001 | Squire | |
| 6,233,928 | B1 | | 5/2001 | Scott | |
| 6,273,080 | B1 | | 8/2001 | Sullivan, Jr. | |
| 6,347,622 | B1 | | 2/2002 | Hsueh | |
| 6,371,099 | B1 | | 4/2002 | Lee | |
| 6,453,593 | B1 | | 9/2002 | Dillon | |
| 2002/0078616 | A1 | | 6/2002 | Perry et al. | |
| 2003/0005614 | A1 | | 1/2003 | Cossio | |
| 2003/0041849 | A1 | | 3/2003 | Perry et al. | |

* cited by examiner

*Primary Examiner*—John A. Ricci
(74) *Attorney, Agent, or Firm*—John A. Thomas

(57) ABSTRACT

A ball sizer for a paint-ball gun includes a bore having an entrance. In the preferred embodiment, the bore has a chamfer, which in turn has a smooth transition from the entrance to the bore of the sizer. The transition may define a section of a parabola, a section of a circle, or a combination of a straight line with a transition to a curve, such as a section of a parabola or circle. Similar transitions may be provided at the exit of the ball sizer, and at the entrance to the barrel attached to the exit of the sizer, or both.

7 Claims, 2 Drawing Sheets

BARREL AND BALL SIZER FOR PAINT-BALL GUN

FIELD OF INVENTION

The present invention relates to guns that propel projectiles using compressed gas as a propellant. More particularly, it relates to an improved gun barrel for use in combination with a gas powered projectile gun firing soft or pliable ammunition such as paint balls.

BACKGROUND

A popular use for paint-ball guns is in recreation, where the participants fire paint-ball projectiles toward a target. The target may be a moving or stationary paper target used for target practice. The target might be another participant in a game, where the participants are attempting to strike each other with soft paint-filled projectiles. Paint-ball guns fire a plastic-walled, paint- or gelatin-filled projectile using compressed gas as the source of power to accelerate the paint ball down a chamber and into a gun barrel. The paint ball enters the barrel from a hopper at the breech end, is accelerated by compressed gas, and exits the muzzle of the barrel.

Prior art in the area of air-powered guns, and especially paint-ball guns, uses canisters of liquid $CO_2$ or other compressed gas communicated through regulators to provide a regulated gas pressure to the gun. Whether the paint ball is spinning, and in what direction, when it exits the barrel, affects its trajectory. The conventional paint ball barrel pushes the ball down the barrel with no controlled spin and many times with no or very little ball rotation. Much like a pitcher's knuckleball, the paint ball will move erratically as the ball exits the barrel, due to the supercritical eddy currents behind the ball. The paint ball moving with no rotation develops pressure forces in front of the ball, and eddy currents with supercritical air flow immediately behind the ball resulting in the ball moving erratically. Further, the ball with no rotation develops significantly more drag in front of the ball as it moves through the air.

Paint balls have a liquid center covered by a thin plastic or gelatin membrane that maintains the paint ball in an approximately sperical shape. This soft formation and thin-walled construction cause frequent deformities in the shape of the paint ball, making it less than perfectly round. A seam is formed in the plastic membrane during manufacturing, which also tends to interrupt the otherwise smooth exterior surface of the plastic membrane. Because paint balls come in various diameters, the air pressure used to accelerate the ball is affected by any diameter difference between the ball and the barrel.

The lack of consistency in size and shape of the paint ball ammunition can further be affected by temperature and humidity of the site of use. Humid weather tends to swell the paint balls because the water in the air softens the plastic membrane defining the dimensions of the ball. Hot weather increases the volume of the paint contained in the ball, and thus also affects the overall dimensions of the paint ball by pressing outward on the plastic membrane cover.

Since paint balls may thus have different diameters due to manufacturing tolerances and expansion because of heat or humidity, paint-ball guns typically use a "ball sizer" attachment between the breech of the gun and the barrel. The paint ball enters the ball sizer first and is accelerated there by gas pressure to essentially its maximum velocity before entering the barrel of the gun. The user chooses a ball sizer of the appropriate diameter to match as nearly as possible the size of the paint balls he is using at that time. Ball sizers typically connect with a barrel and with the breech of the gun with threaded joints.

The seam in the paintball has a natural tendency to spin the paint ball as the ball passes through the ball sizer, resulting in erratic spinning of the ball and an erratic trajectory. If the entrance to the ball sizer, or the joint between the ball sizer and the barrel, catches the seam of the ball, the ball will also have an erratic spin. In some cases, this catching of the seam will cause the ball to rupture before leaving the barrel.

Conventional smooth-bore paint ball gun barrels do little to rectify the ball spin caused by the imperfect paint-ball exterior surface and the variance in size caused by manufacturing or temperature and humidity. Paint balls expanded from humidity or temperature spin worse on exit from the gun barrel due to increased contact with the sidewall of the barrel bore if the contact with the barrel is not a controlled contact. Imperfect surfaces, such as the seam of the paint ball, also impart spin to the exiting paint ball due to contact with the interior surface of the gun barrel. Combinations of temperature, size differential, and surface imperfections can combine to affect the trajectory of an exiting paint ball severely, and render the accuracy of the gun to a very poor state. Therefore, it is important to smoothly accelerate the ball to its maximum velocity in the ball sizer.

SUMMARY

A ball sizer for a paint-ball gun includes a bore having an entrance. In the preferred embodiment, the bore has a chamfer which in turn has a smooth transition from the entrance to the bore of the sizer. The transition may define a section of a parabola, a section of a circle, or a combination of a straight line with a transition to a curve, such as a section of a parabola or circle. Similar transitions may be provided at the exit of the ball sizer, and at the entrance to the barrel attached to the exit of the sizer, or both.

DRAWINGS

DETAILED DESCRIPTION

Figure 1:
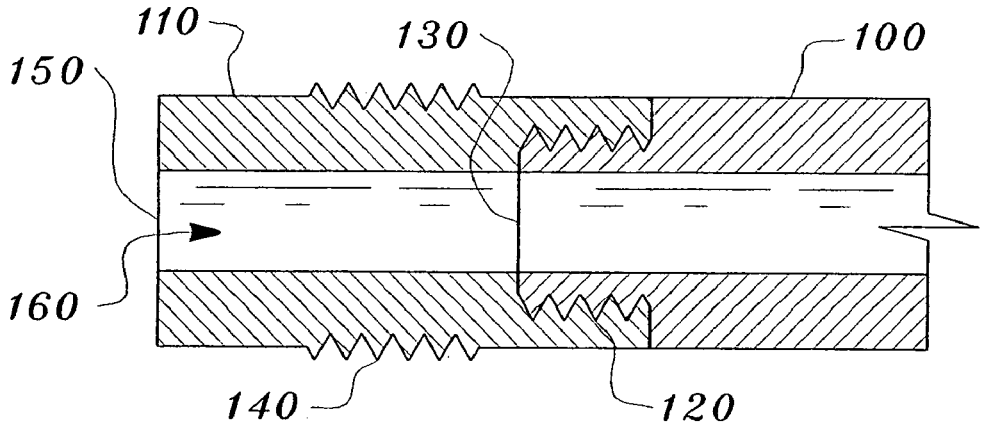
PRIOR ART Fig. 1
FIG. 1 is cut-away side view of a prior-art paint ball ball sizer and barrel.

FIG. 1 shows a cut-away view of a typical prior-art paint-ball gun barrel (100) connected to a ball sizer (110). In this and other figures, the wall thickness of the barrel and sizer is exagerated for clarity. The prior-art ball sizer (110) has a bore (150) defined by an entrance (150). Typically, the face of the entrance (150) is flush, as shown, creating a sharp boundary that a paint ball must cross as it is propelled by gas pressure into the sizer (110). This sharp boundary at the entrance (150) may catch the seam of the ball, causing erratic spin, and possibly, rupture of the ball. FIG. 1 also shows threads (140) on the sizer (110), where the sizer screws into the breech of a paint-ball gun. The barrel (110) also has threads (120) to allow it to be screwed into the sizer (110). It is difficult to make the resulting joint (130) between the barrel (100) and the ball sizer (110) exactly even, and this uneven joint (130) can also catch the seam or skin of the ball and impart erratic spin, or cause a rupture.

Figure 2:
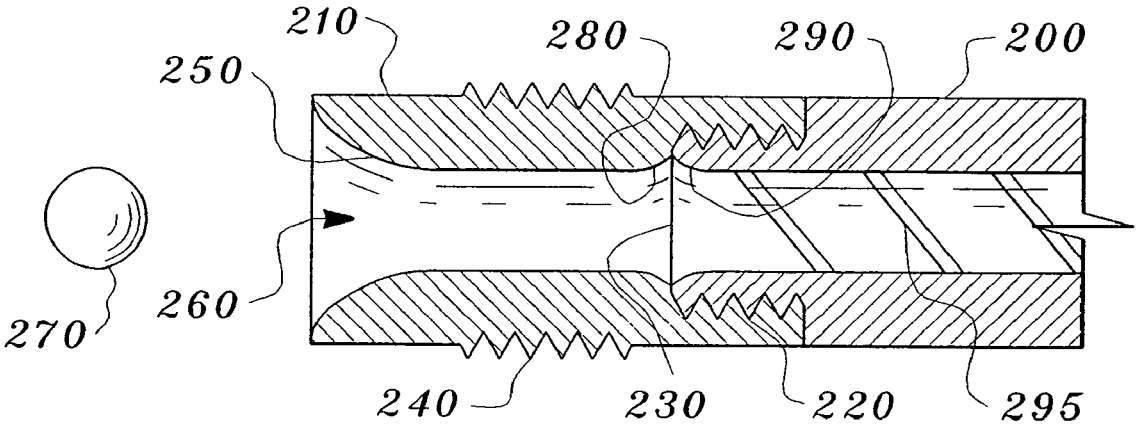
FIG. 2 is a cut-away side view of the preferred embodiment of the ball sizer and barrel.

FIG. 2 is a cut-away view of the preferred embodiment. The barrel (200) is again screwed into the ball sizer (210). A paint ball (270) is positioned to enter the bore (260) of the sizer (210). In the preferred embodiment, the entrance to the sizer (210) has a chamfer (250) with smooth transitions. This chamfer (250) is preferably an arc of a parabola, to smoothly guide the ball (270) into the bore (260). Other curves could be used for the chamfer (250), however, such as a section of a circle. The sizer (210) has outer threads (240) to allow it to be screwed into the breech of a paint-ball gun. The exit of the sizer (210) is joined to a barrel (200) by threads (220). In the preferred embodiment, the joint (230) formed at the juncture of the barrel (200) and the sizer (210) is also defined by a chamfer (280) in the sizer (210) and in the barrel (290).

Again, these chamfers (280, 290) may be described by the arc of a parabola, or other curves. In this way, the ball (270) may transition smoothly from the breech to the sizer (210), and from the sizer (210) into the barrel (200). The barrel (200) may have rifilings (295) to impart a stabilizing rotation to the ball (270).

Figure 3:
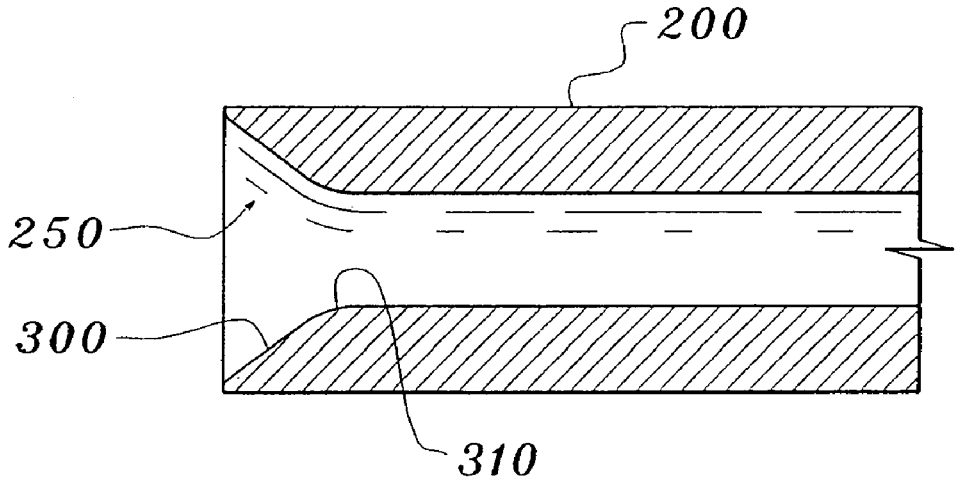
FIG. 3 is a cut-away side view of another embodiment of the ball sizer and barrel.

FIG. 3 shows a cut-away view of another embodiment. Here, the chamfer (250) in the entrance to the sizer (210) is defined by a straight-line part (300) and a curved part (310). Again, the curved part (310) may be any of the curves just discussed. A similar straight-line and curved combination chamfer may be used for the chamfers (280, 290) at the exit of the sizer (210) and the entrance of the barrel (200). The straight-line part (300) may precede the curved part (310) in this combination.

Figure 4:
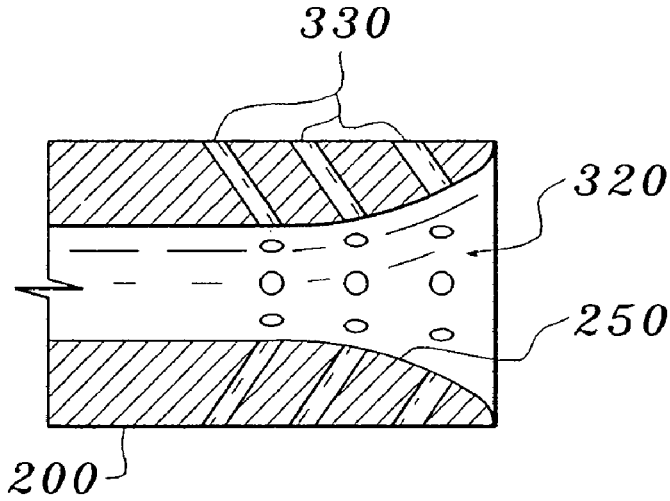
FIG. 4 is a cut-away side view of another embodiment, showing the muzzle area of a barrel.

FIG. 4 shows a cut-away view of another embodiment. Here the chamfer (250) is placed in the muzzle (320) of the barrel (200). The chamfer (250) may have a curve among those previously described, including the combination straight-line and curved parts. The figure also shows reverse ports (330) in the muzzle. Such ports are advantageous to release pressure in the barrel behind the moving paint ball in a controlled way, and also to lower the sound pressure released down range of the gun. The chamfer (250) in the muzzle (320) functions with the reverse porting to reduce the pressure in front of the ball, while centering the ball on an effective air bearing. This introduces the ball into the atmosphere with reduced shock and turbulence and improves accuracy Since those skilled in the art can modify the specific embodiments described above, I intend that the claims be interpreted to cover such modifications and equivalents.

I claim:

1. A ball sizer for a paint-ball gun, comprising:

a bore, the bore having an entrance and an exit;

the entrance to the bore having a chamfer; and, the chamfer having a smooth transition from the entrance to the bore of the sizer, where the smooth transition of the chamfer comprises a first part defining a straight line; and a second part defining a curve; and, where the outer diameter of the ball sizer is substantially constant from the entrance to the exit.

2. The ball sizer of claim 1 where the curve of the second part defines a section of a parabola.

3. The ball sizer of claim 1 where the curve of the second part defines a section of a circle.

4. A ball sizer for a paint-ball gun, comprising:

a bore, the bore having an entrance and an exit;

the exit to the bore having a chamfer; and, the chamfer having a smooth transition from the bore to the exit of the sizer, where the smooth transition of the chamfer comprises a first part defining a straight line; and a second part defining a curve; and, where the outer diameter of the ball sizer is substantially constant from the entrance to the exit.

5. The ball sizer of claim 4 where the curve of the second part defines a section of a parabola.

6. The ball sizer of claim 4 where the curve of the second part defines a section of a circle.

7. A ball sizer for a paint-ball gun, comprising:

a bore, the bore having an entrance and an exit;

the entrance to the bore having a chamfer; and, the chamfer having a smooth transition from the entrance to the bore of the sizer;

the exit from the bore having a chamfer; and, the chamfer having a smooth transition from the bore of the sizer to the exit, where the smooth transitions of the chamfer comprise a first part defining a straight line; and a second part defining a curve; and, where the outer diameter of the ball sizer is substantially constant from the entrance to the exit.

* * * * *